US009554634B2

(12) United States Patent
Yoe

(10) Patent No.: US 9,554,634 B2
(45) **Date of Patent: *Jan. 31, 2017**

(54) AIRFLOW CONCENTRATOR FOR ELECTRIC HAIRDRYER

(76) Inventor: Han Hian Yoe, Shenzhen (CN)

( * ) Notice: Subject to any disclaimer, the term of this patent is extended or adjusted under 35 U.S.C. 154(b) by 919 days.

This patent is subject to a terminal disclaimer.

(21) Appl. No.: 13/397,668

(22) Filed: Feb. 15, 2012

(65) Prior Publication Data

US 2012/0311882 A1 Dec. 13, 2012

(30) Foreign Application Priority Data

Jun. 13, 2011 (CN) ..... 2011 2 0197604 U

(51) Int. Cl.
*A45D 20/12* (2006.01)

(52) U.S. Cl.
CPC ..... *A45D 20/12* (2013.01)

(58) Field of Classification Search
CPC ..... A45D 20/12; A45D 20/122; A45D 20/10; A45D 20/00; A45D 20/124
USPC ..... 34/98
See application file for complete search history.

(56) References Cited

U.S. PATENT DOCUMENTS 5,471,763 A * 12/1995 McArthur ..... 34/96
2006/0213074 A1* 9/2006 Kamada ..... 34/96
2011/0121106 A1* 5/2011 Yoe ..... 239/548

FOREIGN PATENT DOCUMENTS

WO WO 2010108415 A1 * 9/2010

* cited by examiner

*Primary Examiner* — Jason Lau
(74) *Attorney, Agent, or Firm* — Novoclaims Patent Services LLC; Mei Lin Wong

(57) ABSTRACT

An airflow concentrator for electric hairdryer includes a airflow divider connected with the electric hairdryer, an airflow generated by the electric hairdryer is divided and deflected in the airflow divider, and then flowed out of the airflow divider, two connecters connected with the airflow divider respectively, and two airflow nozzles connected with the two connecters respectively, wherein the airflow flowed out from the airflow divider is deflected in the airflow nozzles, and then flowed out of the airflow nozzles.

1 Claim, 6 Drawing Sheets

AIRFLOW CONCENTRATOR FOR ELECTRIC HAIRDRYER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an electric hairdryer, and particularly relates to an airflow concentrator for the electric hairdryer.

Description of Related Arts

An electric hairdryer is a common hair-care tool for drying and styling hair. Usually, the electric hairdryer is used to provide cool or hot airflow over wet or damp hair in order to dry hair after hair wash rapidly. The common electric hairdryer generally provide several types of airflow to control the temperature and speed of the airflow, such as hot-fast airflow, hot-slow airflow, cool-fast airflow and cool-slow airflow. To dry the hair in the shortest time, the hot fast airflow is a preferable choice and, moreover, the nozzle of the electric hairdryer is preferably closed to the scalp so that the electric hairdryer can blow the hot-fast airflow to dry the root of the hair. However, at the same time, the user may feel uncomfortable because of the strong and hot airflow directly blew towards the scalp. Although it may dry the hair faster, the nozzle of the electric hairdryer is so closed to the scalp that the hot air may cause scalded to the scalp. If the scalp is scalded, it may not only cause uncomfortable to the user, but also, in the worst situation, may result in hair-loss and stopping hair-grow. Accordingly, people install an airflow concentrator to the nozzle of the hair. The function of the airflow concentrator is to concentrate, collect and speed up the airflow. It is a type of drying method that provides a faster speed of the airflow instead of the higher temperature of the conventional type, so as to reduce the possibility of hurting the scalp. However, if the airflow blew directly towards the scalp, it will still cause uncomfortable feeling.

With the development of the living standard of people, more and more people like to own a pet. The common choice is cats or dogs but it is not a easy task in cleaning, especially to dry their hair after bath. Generally, an electric hairdryer will be used. As mentioned above, the conventional electric hairdryer blows airflow directly towards the scalp, and thus when a conventional electric hairdryer is used for the pets, such as cats or dogs, the pet will feel uncomfortable if the speed of the airflow is too fast that may require more effort to get dry. On the other hand, if a weak airflow is used, it may require more time to deal with.

SUMMARY OF THE PRESENT INVENTION

The invention is advantageous in that it provides an airflow concentrator for electric hairdryer, which provides an inclined nozzle for improving the utilization rate of the airflow blew from the electric hairdryer and reducing the time for hair drying.

Another advantage of the invention is to provide an airflow concentrator for electric hairdryer, which has an adjustable concentrating nozzle, which is adjustable for drying hair in desired style according to different hair styles in the shortest time.

Another advantage of the invention is to provide an airflow concentrator for electric hairdryer, which has a detachable airflow nozzle for reducing the maintenance cost thereof.

Another advantage of the invention is to provide an airflow concentrator for electric hairdryer, in which an airflow outlet is provided in the airflow nozzle adapted for changing the airflow direction therethrough to avoid direct air blew towards the drying hair.

Another advantage of the invention is to provide an airflow concentrator for electric hairdryer, which has a simple structure for mass production and manufacturing cost reduction.

Additional advantages and features of the invention will become apparent from the description which follows, and may be realized by means of the instrumentalities and combinations particular point out in the appended claims.

According to the present invention, the foregoing and other advantages are attained by providing an airflow concentrator for an electric hairdryer, which comprises:

an airflow divider which is adapted to be connected with the electric hairdryer so that an airflow generated by the electric hairdryer is divided and deflected by the airflow divider and flowed out of the airflow divider;

two connecters which are connected with the airflow divider; and two airflow nozzles which are connected with the two connecters respectively, wherein the airflow flowed out from the airflow divider is deflected and then flowed out via the airflow nozzles.

The airflow divider has two inclined divider outlets, wherein, preferably, an angle between a center line of the divider outlet and a center line of the airflow concentrator is 9°-19°.

Each of the airflow nozzles further has a first airflow guiding surface, a second airflow guiding surface and a pair of protuberances protruded at two side surfaces thereof respectively.

In which, the first airflow guiding surface is a curved surface, wherein a tangent line is defined from a connecting portion of the airflow guiding surface and extended along the first airflow guiding surface, wherein an angle defined between the tangent line and a cross section of a connection area of the respective connecter and the connecting portion increases gradually.

The second airflow guiding surface is a curved surface too, wherein a tangent line is defined from the connecting portion of the airflow guiding surface and extended along the second airflow guiding surface, wherein an angle defined between the tangent line and a cross section of the connection area of the respective connecter and the connecting portion decreases gradually, so that the airflow can be deflected along the second airflow guiding surface.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
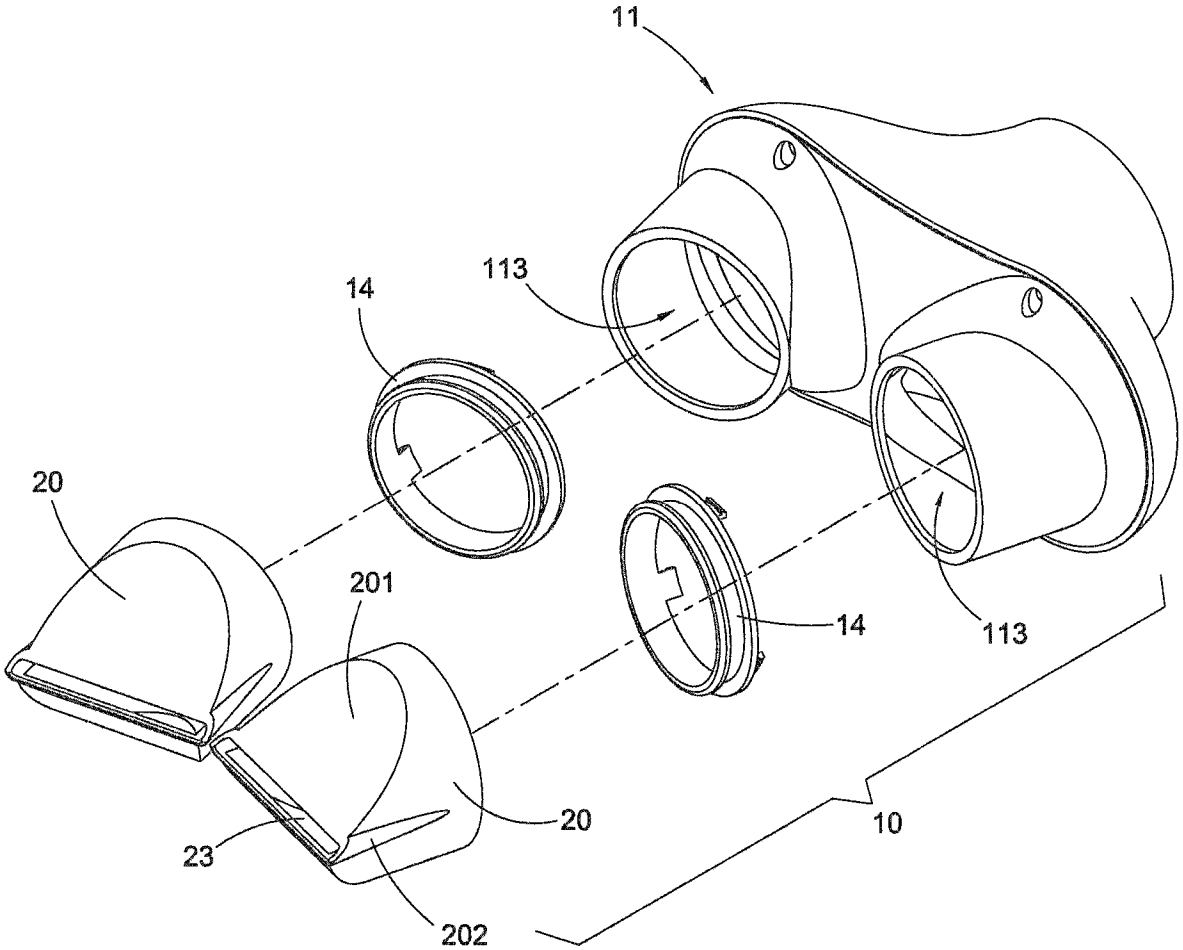
FIG. 1 is an exploded view of an airflow concentrator for electric hairdryer according to a preferred embodiment of the present invention.

The following description is disclosed to enable any person skilled in the art to make and use the present invention. Preferable embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 4, an airflow concentrator 10 for an electric hairdryer according to the preferred embodiment of the present invention is illustrated, wherein the airflow concentrator 10 comprises an airflow divider 11, which is connected with the electric hairdryer so that an airflow generated by the electric hairdryer is divided and deflected by the airflow divider and flowed out of the airflow divider 11. In other words, the airflow direction flowed out the airflow divider 11 and the airflow direction flowed in the airflow divider 11 are different.

The airflow concentrator 10 further comprises two connecters 14 and two airflow nozzles 20, wherein the two connecters 14 are adapted to connect the two airflow nozzles 20 with airflow divider 11 respectively. The airflow flowed out the airflow divider 11 will flow into the airflow nozzles 20, and then flow out of the airflow nozzle after the airflow was deflected in the airflow nozzle. In other words, the airflow nozzle 20 is capable of changing the airflow direction, that is the direction of the airflow flowed into the airflow nozzle 20 is different from the direction of the airflow flowed out the airflow nozzle 20. The two connecters 14 which connect the airflow divider 11 with two the airflow nozzle 20 respectively for guiding the airflow flowed out of the airflow divider 11 to flow into the airflow nozzles 20 through the connecters 14 respectively. Each side of the connecter 14 comprises a fastening structure for firmly connecting the airflow divider 11 with the respective airflow nozzle 20. After the airflow generated by the electric hairdryer flows into the airflow divider 11, the airflow is divided and deflected in the airflow divider 11 and then flows out of the airflow divider 11. The airflow flowed out of the airflow divider 11 flows through the two connecters 14 and the two airflow nozzles 20 respectively, and then flows out of the airflow nozzles 20 after the airflow is deflected again in the airflow nozzles 20 respectively.

The airflow divider 11 further has a connecting opening 111 which is connected to the electric hairdryer for the airflow generated by the electric hairdryer to flow into the airflow divider 11 therethrough. The airflow divider 11 further has a dividing chamber 112 communicated with the connecting opening 111 for dividing the airflow flowed from the connecting opening 111. The airflow divider 11 further has two divider outlets 113, which are inclinedly provided on the airflow divider 11 and communicated with the dividing chamber 112 respectively for deflecting the airflow from the dividing chamber 112 to flow out of the airflow divider 11 through the two divider outlets 113.

Figure 2:
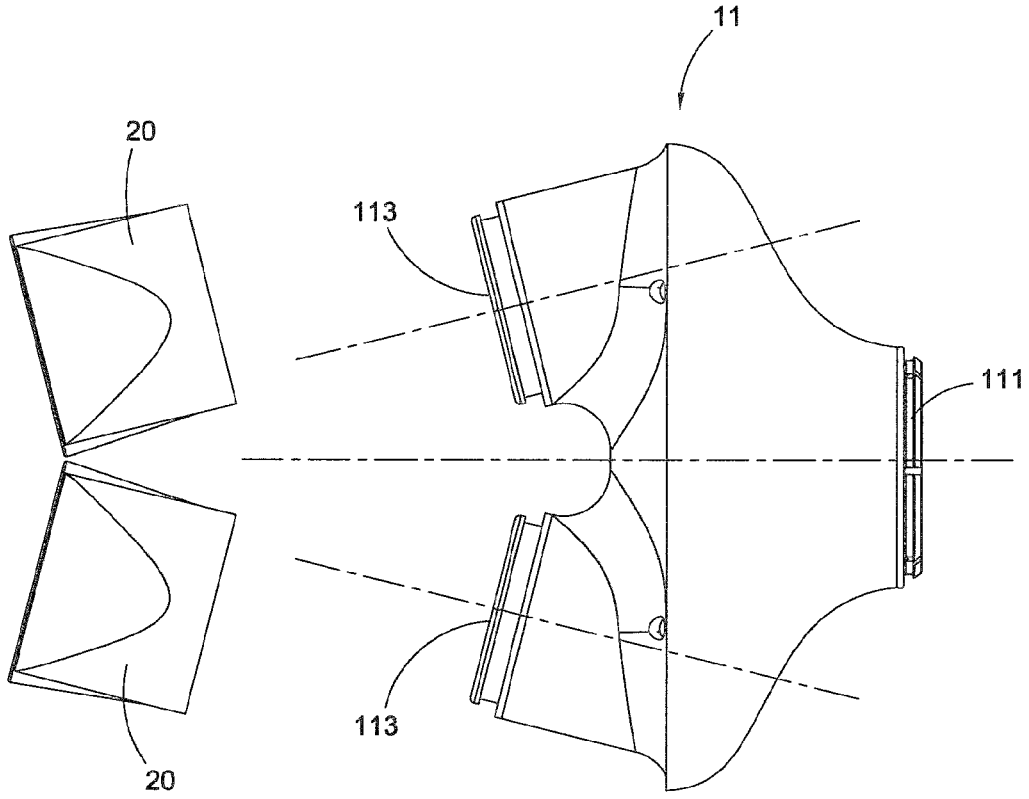
FIG. 2 is a perspective view of an airflow concentrator for electric hairdryer according to above preferred embodiment of the present invention, illustrating the main body and the airflow nozzles separately.

In addition, in order to ensure the airflow concentrator 10 to be firmly connected with the electric hairdryer, the connecting opening 111 further comprises a fastening structure provided between the connecting opening 111 and a connecting end of the electric hairdryer, wherein the fastening structure has a set of "U" shaped notches to ensure the airflow concentrator 10 being firmly connected with the electric hairdryer. Furthermore, in order to enable the airflow concentrator 10 being compatible with the current electric hairdryer, the connecting opening 111 is preferred to be in circular shape. On the other hand, the connecting opening 111 can be constructed in any other shape. The two divider outlets 113 are inclined in such a manner that the two divider outlets 113 are inclined towards a center line of the airflow concentrator 10 so as to ensure the airflow flowing into the divider outlet 113 to be deflected due to the inclination of the divider outlets 113. Preferably, the angle between each of two the inclined divider outlets 113 and the center line of the airflow concentrator 10 is 9°-19°, as shown in FIG. 2.

Figure 3:
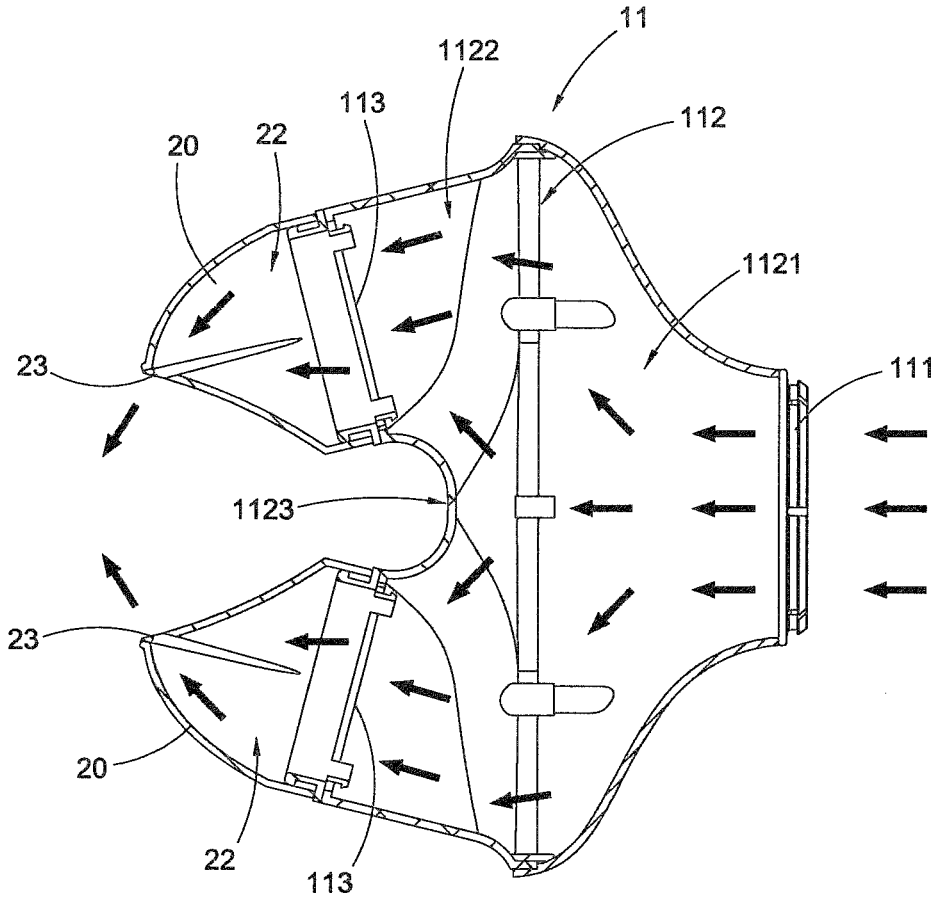
FIG. 3 is a sectional view of the airflow concentrator for electric hairdryer according to above preferred embodiment of the present invention.

As shown in FIG. 3, the dividing chamber 112 further has a diffusing portion 1121 and a dividing portion 1122, wherein the diffusing portion 1121 and the connecting opening 111 connected with each other so as to diffuse the airflow from the connecting opening 111. Then, the diffused airflow flows into the dividing portion 1122 and is divided in the dividing portion 1122. In order to achieve better diffusion effect of the airflow, the airflow begins to be diffused at the connecting portion of the diffusing portion 1121 and a connecting opening 111 towards the two inclined divider outlets 113, and that a maximum amount of diffusion is achieved at a connection portion of the diffusing portion 1121 and dividing portion 1122. The dividing portion 1122 is connected with the diffusing portion 1121, and the dividing portion 1122 is connected with two the divider outlets 113. The two inclined divider outlets 113 are provided at two sides of the dividing portion 1121 of the dividing chamber 112 respectively while the two divider outlets 113 are inclined towards the center line of the airflow concentrator 10. Accordingly, at the connecting portion of the diffusing portion 1121 and the dividing portion 1122, two outer sides of the dividing portion 1122 begins to extend inclinedly towards the center line of the airflow concentrator 10 and connects with the two divider outlets 113 respectively. Two inner sides of the dividing portion 1122 are connected with each other and extended inclinedly towards the center line of the airflow concentrator 10 so as to form a "U" shaped arrangement. When the airflow which has been diffused through the diffusing portion 1121 of the dividing chamber 112 flows into the "U" shaped arrangement 1123 of the diffusing portion 1121 of the dividing chamber 112, the airflow is divided into two flows of airflow flowing to the two divider outlets 113 respectively. The "U" shaped arrangement 1123 is the flow-dividing portion of the dividing portion 1122 of the dividing chamber 112.

Preferably, the connecter 14 and one end of the airflow nozzle 20 are in circular shape, so that the airflow nozzle 20 can be rotated arbitrarily to any angular direction with respect to the connecter 14. In addition, each end of the connecter 14 is provided with a fastening structure so as to facilitate replacement operation and its cost when the connecter 14 or the airflow nozzle 20 is damaged. Moreover, it also facilitates the changing of different airflow nozzles 20 so as to adapt for setting different hair styles.

Figure 4:
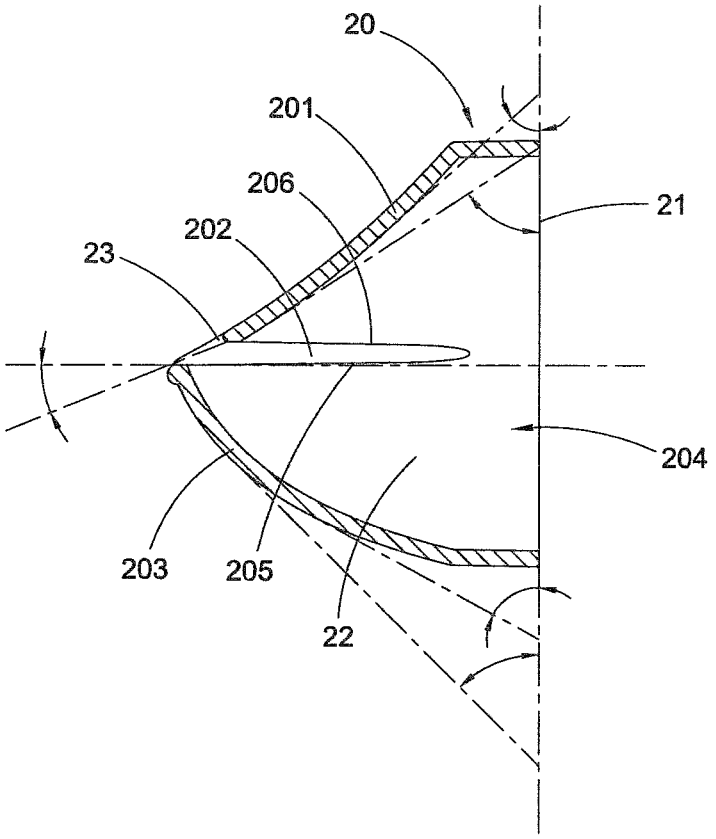
FIG. 4 is a sectional view of the airflow nozzle of the airflow concentrator for electric hairdryer according to above preferred embodiment of the present invention.

As shown in FIG. 4, the airflow nozzle 20 is connected with the divider outlet 113 through the connecter 14. Each of the airflow nozzles 20 further comprises an airflow nozzle connecter 21, a guiding cavity 22, and an airflow outlet 23, wherein the airflow nozzle connecter 21 is connected with the connecter 14 so as to enable the airflow from the divider outlet 113 flowing into the airflow nozzle 20 from the airflow nozzle connecter 21 through the connecter 14. The guiding cavity 22 is communicated with the airflow nozzle connecter 21, so that the airflow from the airflow nozzle connecter 21 is able to be deflected in the guiding cavity 22 and guided to the airflow outlet 23 to flow out of the airflow nozzle 20 through the airflow outlet 23.

As shown in FIG. 4, the airflow nozzle 20 further has a connection portion 204, a first airflow guiding surface 201, a second airflow guiding surface 203, and a pair of protuberances 202 protruded at two side surfaces of the airflow nozzle 20, wherein the connection portion 204 is connected with the connecter 14, so that the airflow from the divider outlet 113 flows into the connection portion 204 through the connecter 14. Preferably, the connection portion 204 has a cylindrical shape on as to facilitate any angular rotation of the airflow nozzle 20 arbitrarily. The two side surfaces of the airflow nozzle 20 are both extended along the connection portion 204 to the airflow outlet 23, so that the two side surfaces of the airflow nozzle 20 are curved surfaces and the two protuberances 202 are respectively located in the corresponding positions in the two side surfaces of the airflow nozzle 20.

Each protuberance 202 has a first edge 205 and a second edge 206. The second airflow guiding surface 203 is extended along the connecter portion 204 to the first edge 205 of the protuberance 202 of the airflow nozzle 20. In other words, the second airflow guiding surface 203 is a curved surface extended along the connection portion 204 to intersect with the first edge 205 of the protuberance 202 of the airflow nozzle 20. With respect to the guiding cavity 22, the second airflow guiding surface 203 is protruded outwardly. In other words, on the second airflow guiding surface 203, a tangent line can be defined from where connecting with the connecting portion 204 and extended along the airflow guiding surface 203, wherein an angle defined between the tangent line and a cross section of the connection area of the respective connecter 14 and the connecting portion 204 of the airflow nozzle 20 decreases gradually. The airflow of the guiding cavity 22 flowing along the second airflow guiding surface 203 deflects to flow out of the airflow outlet 23.

The first airflow guiding surface 201 is a curved surface too. The first airflow guiding surface 201 is extended from the connection portion 204 to the second edge 206 of the protuberance 202 of the airflow nozzle 20. In other words, the first airflow guiding surface 201 is a curved surface extended from the connection portion 204 to intersect with the second edge 206 of the protuberance 202 of the airflow nozzle 20. The first airflow guiding surface 201 is a concave curved surface. In other words, on the first airflow guiding surface 201, a tangent line is defined from a connecting portion of the first airflow guiding surface 201 and extended along the first airflow guiding surface 201, wherein an angle defined between that tangent line and a cross section of a connection area of the respective connecter 14 and the connecting portion 24 of the airflow nozzle 20 increases gradually. The guiding cavity 202 is the cavity defined between first airflow guiding surface 201, the second airflow guiding surface 203 and the two protuberances at the two side surfaces. The angle of the airflow outlet 23 is an angle defined between a straight line, extending from a first intersection of the first airflow guiding surface 201 and the second edge 206 of the protuberance 202 to a second intersection of the second airflow guiding surface 202 and the first edge of the protuberance 202, and the first edge 205 of the protuberance 202. Accordingly, an airflow angle of the airflow outlet 23 is affected by the curvatures of the first airflow guiding surface 201 and the second airflow guiding surface 203. In other words, when the curvatures of the first and second airflow guiding surfaces 201, 203 are changed in such a manner the second intersection of the second airflow guiding surface 203 and the first edge 205 of the protuberance 202 at two sides thereof is elevated with respect to its original position, and the first intersection of the first airflow guiding surface 201 and the second edge 206 of the protuberance at two sides thereof is lowered with respect to its original position, the angle defined between the straight line between the first and second intersections and the first edge 205 of the protuberance 202 decreases with respect to its original angle, i.e. the angle of the airflow outlet 23 is decreased. As shown in FIG. 4, according to the preferred embodiment of the present invention, the range of the angle of the airflow outlet 23 is 15°-50°. The range of the curvature of the first airflow guiding surface 201 is 80°-120°. The range of the curvature of the second airflow guiding surface 203 is 20°-60°.

As shown in FIG. 3, an airflow generated by an electric hairdryer flows into the diffusing portion 1121 of the dividing chamber 112 through the connecting opening 111 of the airflow concentrator 10, wherein after the airflow is diffused in the diffusing portion 1121 of the dividing chamber 112, the airflow flows into the dividing portion 1122 of the dividing chamber 112. The airflow is divided in the dividing portion 1122 of the dividing chamber 112 to flow into the two inclined divider outlets 113 respectively. Then, each of the airflows flows out the divider outlet 113 flows through the respective connecter 14 and the respective connecting opening 21 into the respective guiding cavity 22 of the respective airflow nozzle 20, wherein each of the airflows is deflected in the respective guiding cavity 22 of the respective airflow nozzle 20 and is guided to the airflow outlet 23 to flow out of the airflow outlet 23.

Figure 5A:
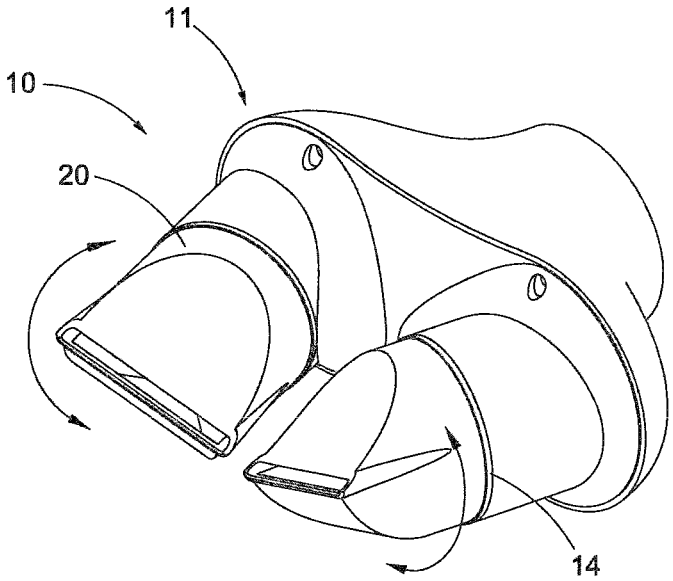
FIG. 5A is a perspective view of the airflow concentrator for electric hairdryer according to above preferred embodiment of the present invention, illustrating the adjustment for drying long hair.

As shown in FIG. 5A, the positions of the two airflow nozzles 20 for setting and drying long hair are illustrated according to preferred embodiment of the present invention, wherein the two airflow outlets 23 of two the airflow nozzles 20 are rotated towards the center line of the airflow concentrator 10 so that the airflows from the two airflow outlets 23 of the airflow concentrator 10 are collected and concentrated towards the center line of the airflow concentrator 10. Accordingly, for setting or drying long hair, it is equivalent to having two airflows from the two the airflow outlets 23 blowing on the same position of the long hair simultaneously so as to reduce the time of hair setting and drying.

Figure 5B:
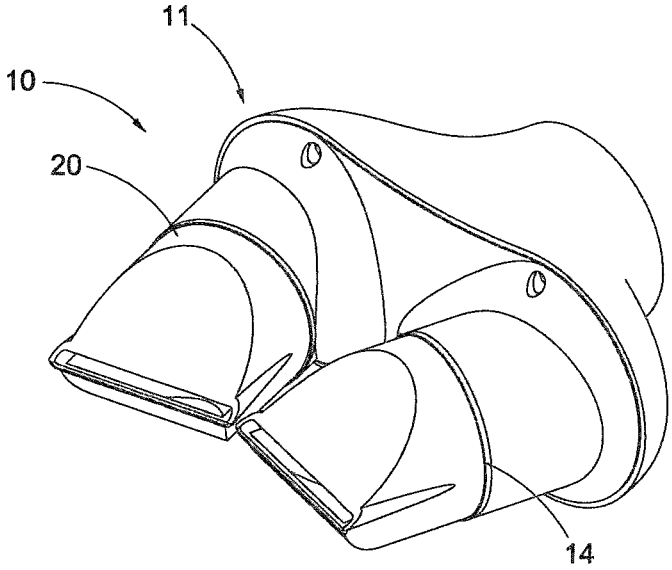
FIG. 5B is a perspective view of the airflow concentrator for electric hairdryer according to above preferred embodiment of the present invention, illustrating the adjustment for drying short hair.

Referring to FIG. 5B, the positions of the two airflow nozzles 20 for setting and drying short hair are illustrated according to preferred embodiment of the present invention. In setting or drying short hair by means of an electric hairdryer, the airflow blowing from the electric hairdryer may directly blow to the scalp and cause uncomfortable feeling. If the airflow from the electric hairdryer is hot, it may even burn the scalp. Therefore, by turning the two airflow outlets 23 of the airflow nozzle 20 of the airflow concentrator 10 outwardly to ensure the two airflow outlets 23 of the airflow nozzle 20 positioning away from the center line of the airflow concentrator 10 and placing the airflow concentrator 10 near the root of the short hair, the airflow will diffuse rapidly with a wide diffusing range along the root of the hair when the airflows rapidly blow from the two airflow outlets of the two airflow nozzles 20, so as to ensure the short hair dried rapidly without any scald of the scalp.

Figure 5C:
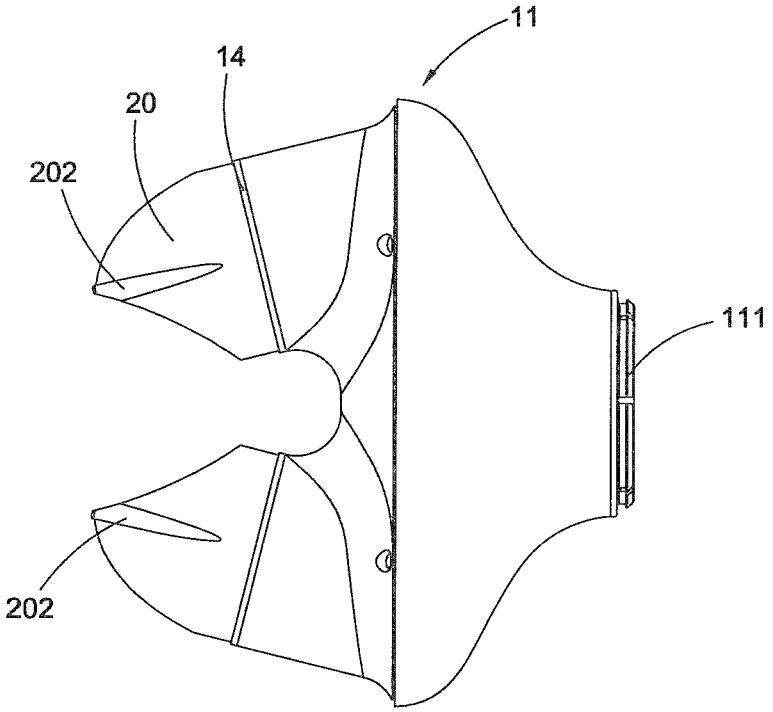
FIG. 5C a perspective view of the airflow concentrator for electric hairdryer according to above preferred embodiment of the present invention, illustrating the adjustment for drying frizzling hair.

Referring to FIG. 5C, the positions of the two airflow nozzles 20 for setting or drying frizzling hair are illustrated according to preferred embodiment of the present invention, wherein the two airflow outlets 23 of the two airflow nozzles 20 are rotated to facing positions with respect to each other, so that, when the airflow concentrator 10 is placed at the frizzling hair, the airflows from two the airflow outlets 23 of two the airflow nozzles 20 can blow rapidly at two sides of the frizzling hair for setting the frizzling hair style rapidly.

Figure 5D:
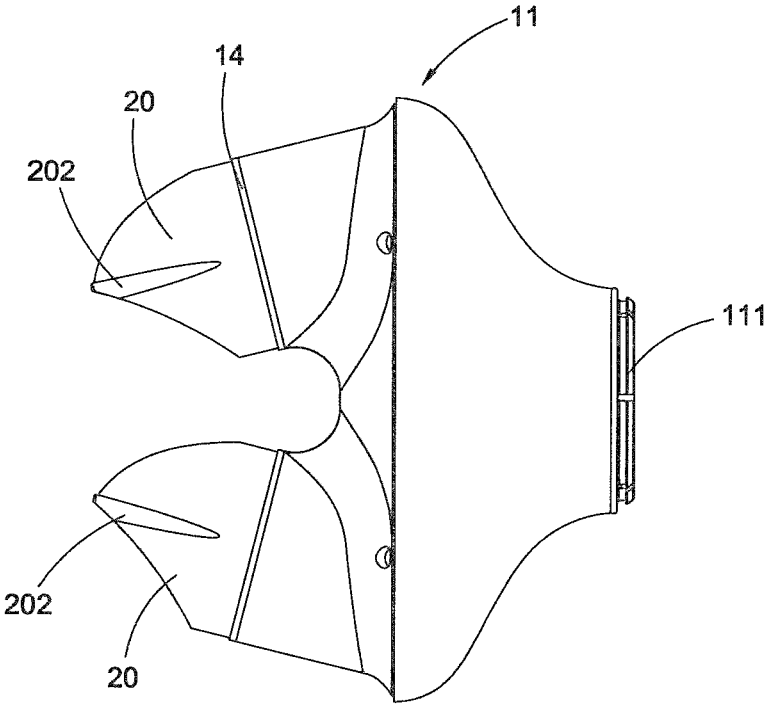
FIG. 5D a perspective view of the airflow concentrator for electric hairdryer according to above preferred embodiment of the present invention, illustrating the adjustment for straight hair.

Referring to FIG. 5D, the positions of the two airflow outlets 23 of two the airflow nozzles 20 for straight hair are illustrated according to the preferred embodiment of the present invention. Based on the positions of the airflow outlets 23 as shown in FIG. 5C, one of the airflow outlets 23 of one of the airflow nozzles 20 is rotated to the same position and direction of the other airflow outlet 23 of the other airflow nozzle 20. By means of such position setting of the two airflow outlets 23 of the two airflow nozzles 20 for straightening hair, it is equivalent to using and moving the conventional electric hairdryer twice at the same so as to save the time for straightening hair.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An airflow concentrator for an electric hairdryer, comprising:

an airflow divider which is adapted for connecting with the electric hairdryer, wherein an airflow generated by the electric hairdryer is divided and deflected by said airflow divider to two airflows to be flowed out of said airflow divider at an altered flowing direction different from the flowing direction generated from the electric hairdryer;

two connecters which are connected with said airflow divider, said two connectors are inclined towards a center line of said airflow concentrator respectively; and two airflow nozzles which are adjustably connected with said connecters respectively, wherein said airflow from said airflow divider is deflected and then flowed out thereof, wherein said airflow, which is generated by said electric hairdryer and flows into said airflow divider, is divided and deflected in said airflow divider and flows out of said airflow divider, wherein said airflows being divided and deflected in said airflow divider flow into said two airflow nozzles through said connecters respectively, are deflected in said airflow nozzles respectively, and flow out of said two airflow nozzles respectively, each of said airflow nozzles further comprising:

an airflow nozzle connecter, which is connected with said respective connecter so as to enable said airflow from said respective divider outlet of said respective airflow divider flowing into said respective airflow nozzle through said respective airflow nozzle connecter;

a guiding cavity, which is communicated with said respective airflow nozzle connecter, wherein said airflow in said respective airflow nozzle is deflected therein; and an airflow outlet, said airflow being deflected in said guiding cavity flowing out of said airflow nozzle therethrough, wherein said airflow from said airflow divider flows into said respective guiding cavity through said respective airflow nozzle connecter, and flow out said respective airflow outlet after being deflected in said respective guiding cavity, each of said airflow nozzles further comprising a connection portion, a first airflow guiding surface, a second airflow guiding surface, and a pair of protuberances protruded at two side surfaces of said airflow nozzle, said two side surfaces of said airflow nozzle being extended along said connecting portion to said airflow outlet, said two protuberances being respectively located in corresponding positions in said two side surfaces of said airflow nozzle, said first airflow guiding surface being extended from said connecter portion to said airflow outlet, said second airflow guiding surface being extended from said connecter portion to said airflow outlet, said airflow outlet being defined between said first airflow guiding surface, said second airflow guiding surface and said two protuberances of said two side surfaces, each said connecting portion defines a central axis, each said airflow nozzle has an asymmetrical structure formed through a differential angle of curvature between said first airflow guiding surface and said second airflow guiding surface such that said airflow outlet has a central axis different from the central axis of said connecting portion for facilitating airflow deflection;

said first airflow guiding surface being a curved surface, wherein a tangent line is defined from a connecting portion of the airflow guiding surface and extended along the first airflow guiding surface, wherein an angle defined between the tangent line and a cross section of a connection area of the respective connecter and the connecting portion across the cross section of the first airflow guiding surface increases gradually in such a manner that said first airflow guiding surface has a concave cross section, said second airflow guiding surface being a curved surface, wherein a tangent line is defined from the connecting portion of the airflow guiding surface and extended along the second airflow guiding surface, wherein an angle defined between the tangent line and a cross section of the connection area of the respective connecter and the connecting portion across the cross section of the second airflow guiding surface decreases gradually in such a manner that said second airflow guiding surface has a convex cross section, so that the airflow can be deflected along the second airflow guiding surface such that the airflow enter from said airflow divider and the airflow flowing out from said airflow divider are different in flowing direction, wherein a range of an angle of said airflow outlet is 15°-50°, wherein said angle of the airflow outlet is an angle defined between a straight line and a first edge of said protuberance, wherein said straight line is formed by extending from a first intersection of said first airflow guiding surface and a second edge of said protuberance to a second intersection of said second airflow guiding surface and said first edge of said protuberance.

* * * * *